US005098101A

United States Patent [19]

Jones

[11] Patent Number: 5,098,101

[45] Date of Patent: Mar. 24, 1992

[54] METHOD OF RECORDING AND TRACKING TIMED EVENTS IN A GAME

[76] Inventor: Benjamin B. Jones, 722½ Harrison Ave., Beloit, Wis. 53511

[21] Appl. No.: 593,473

[22] Filed: Oct. 1, 1990

Related U.S. Application Data

[63] Continuation of Ser. No. 293,009, Jan. 3, 1989, abandoned.

[51] Int. Cl.[5] ..... A63F 9/00; G04B 19/28

[52] U.S. Cl. ..... 273/148 R; 273/240; 368/27; 368/41; 235/89 R

[58] Field of Search ..... 273/246, 247, 243, 251-254, 273/94, 148 R, 240; 368/41, 42, 44; 235/89 R

[56] References Cited

U.S. PATENT DOCUMENTS

| | | | |
|---|---|---|---|
| 283,408 | 8/1883 | MacDonnell | 368/42 |
| 301,215 | 7/1884 | Cory | 368/27 |
| 614,937 | 11/1898 | Dietz | 368/27 |
| 1,966,971 | 7/1934 | Rochlus | 235/89 R |
| 2,014,754 | 9/1935 | Wheeler | 368/41 |
| 2,159,917 | 5/1939 | Wagner | 368/42 |
| 2,268,239 | 12/1941 | Braajen | 368/27 |
| 2,275,306 | 3/1942 | Morrison et al. | 273/94 R |
| 2,650,764 | 9/1953 | Pirszel | 235/88 R |
| 2,650,765 | 9/1953 | Pirszel | 235/88 R |
| 3,184,161 | 5/1965 | Schwarz et al. | 235/89 R |
| 3,282,501 | 11/1966 | Copeland | 235/89 R |
| 3,318,085 | 5/1967 | Lee | 368/27 |
| 3,547,441 | 3/1969 | Thornton | 273/94 R |
| 4,082,278 | 4/1978 | Bolton | 273/94 R |
| 4,222,227 | 9/1980 | Arabian | 368/27 |
| 4,456,821 | 6/1984 | Harter | 235/89 R |
| 4,502,789 | 3/1985 | Heath | 368/27 |

*Primary Examiner*—Benjamin Layno

*Attorney, Agent, or Firm*—Willian Brinks Olds Hofer Gilson & Lione

[57] ABSTRACT

A recorder of multiple events and durations of time, using one or more rotatably mounted dials graduated in a clockwise direction, with a means for displaying temporary memoranda which describe events associated with the said graduations, and used for directly recording and reading the actual or simulated times of one or more events either in absolute time or relative to the current time.

3 Claims, 4 Drawing Sheets

METHOD OF RECORDING AND TRACKING TIMED EVENTS IN A GAME

This application is a continuation of application Ser. No. 07/293,009, filed Jan. 3, 1989, now abandoned.

BACKGROUND OF THE FIELD AND RELATED APPLICATIONS

Event recorders and program clocks are known which are used to keep track of individual events and the starting and ending points of processes. These are found in two broad classes. One class is that of reminder clocks and program clocks, and typically incorporate a clock mechanism which keeps track of the acutal passage of time.

The other class comprises devices which only simulate the passage of time, and the actual time taken to advance the device may bear little relation to the amount of time the movement simulates. Examples of these are game counters in military simulation games, which may represent the passage of a minute, hour, year or century by the movement of a token or simple pointer.

The present invention relates to both of these classes equally. The embodiments which apply to the two classes differ only in that the first must have an appropriate clock movement to rotate its dials automatically, and the second must not have one. The embodiments have different backgrounds, and so will be discussed separately.

EMBODIMENT A: REMINDER CLOCK

In this embodiment the present invention relates to reminder clocks, programs clocks, chronographs, etc. Most of these can only use absolute time, that is time measured by time of day, rather than with durations or lengths of time measured in relation to the current time. In addition, they are usually limited in the range of time which they can handle, usually one twleve hour period, and cannot accurately deal with both minutes and hours. Examples of these are the Reminder Clock (U.S. Pat. No. 3,233,401), the Clock with Hooks (U.S. Pat. No. 4,208,870), and the Mono Ringed Rotatory Medication Reminder (U.S. Pat. No. 4,345,541). Other event recorders are able to use relative time in addition to absolute time, to mark the end of a fixed duration of time starting in the present. These can provide a signal at the end of the duration, provide the time of day at which of the end of the duration occurs, and possibly provide several different kinds of information about the same duration, but are unable to deal with more than one independent event at once. Examples of these are the Chronograph (U.S. Pat. No. 3,747,324) and the Clock with Rotatable Ring (U.S. Pat. No. 4,392,750). Furthermore, like the Reminder Clock, these are limited in the range of time that they can handle.

With the invention of electronic timing devices, both the number of events and the range over which accurate timing can be done have increased dramatically, but these do not instantly provide an intuitive grasp of the order and duration of events in the way that glancing at a clock does. They also are expensive and complex in manufacture and do not provide a fast means of entering and altering entries.

The present invention allows the accurate and simultaneous use of several different scales of time, permits a large number of simultaneous events to be displayed, added, and removed in an intuitively pleasing and easily understood manner, and deals equally well with lengths of time and absolute times and dates.

EMBODIMENT B: TIMEKEEPER FOR SIMULATIONS AND GAMES

The second embodiment of this invention relates to the use of time in simulations of complex processes, and to games such as military simulation games in which such simulations may take place. Currently all such games use a variant of a system in which all players perform their chosen action in a game turn, defined as some fixed length of time, appropriate for the scale of events simulated in the game. In some games a simple pointer or counter is used to keep track of the turns. This fixed length of time forces events which normally would be of quite different duration to take the same time, and to start and stop at the same moment. Hence the realism of the simulation suffers.

By the use of the present invention all such events may be timed independently and simultaneously, using the time scale appropriate to the event rather than that forced by the time scale of the turn. This dramatically improves the realism of the game while maintaining, and in some cases improving, the ease with which the events in the game are organized.

In research simulations of complex processes, time units of any conceivable size can simulated by the construction of a suitable dial, but most often a dial divided in tenths or hundredths. For example, atomic events occurring on a time scale of picoseconds, and cosmic events on a time scale of eons may both be simulated by the same set of dials divided into tenths or hundredths, simply by changing the scale used.

SUMMARY OF THE INVENTION

The present invention relates to an event recorder, comprising a dial in the form of ring or disk, similar to a clock dial, with gradations and numbers graduated in a clockwise direction on its edge matching the time scale over which the particular disk is intended to operate and which rotates or allows rotation in a clockwise direction on or within a flat erasable writing surface or other means for displaying memoranda, providing an efficient means of indicating the recorded event which is considered current, and also the time until occurrence of any other recorded event, and the location at which to record a new event such that the time until its occurrence is displayed. It is different from a clock dial, and from current program clocks, in that it is the disk that rotates rather than a clock hand. In the preferred embodiment the gradation corresponding to zero units of time is a more prominent pointer in order to better indicate the recorded event considered to be current, or occurring "now". At least one reference mark is fixed in place near the edge of the disk, and is used to help align the disk with the memoranda, and to permit the determination of whether the disk has undergone a full rotation. In the preferred embodiment a set of gradations matching those on the dial itself is displayed in a fixed position concentric with the dial, in order to prevent inaccuracy when writing or displaying memoranda on the invention. Combinations of several dials with different scales allows the simultaneous use of different magnitudes of time scale, such as a set of four dials for recording events over secodns, minutes, hours and days, respectively.

In the preferred embodiment, the dial is transparent or ring shaped, and through it is visible a second dial with the same scale of numbers as the dial itself, but fixed in position coaxially with the rotatable dial. A hand or pointer on the rotatable dial indicates the actual time of day, day of the month, etc, on this inner dial.

The invention has many advantages of simplicity of design and use over program clocks in current use:

1. It allows the user to deal simultaneously with widely diverging scales of time, from seconds to years or more, with no loss of accuracy.

2. It allows the user to directly read the sequency, and time until occurrence, of all events recorded on the device, and in a very clear, intuitive fashion.

3. It allows the user to refer to either or both real time (i.e. time of day, day of month, etc.) and relative time (minutes, hours, days, etc. until the event), both when recording events on the invention and when reading information from it.

4. It allows the user to quickly add, remove, and change the time of any event on the invention without affecting any other entry, and in an intuitively pleasing fashion,.

5. It allows the user to use a variety of means for recording the memoranda on the same embodiment of the invention, in a variety of styles, and with varying degrees of permanence.

6. It is extremely simple in construction and allows manufacture at a very low cost.

DESCRIPTION OF THE INVENTION

A: Preferred Embodiment of Game or Simulation Timekepper

Figure 1:
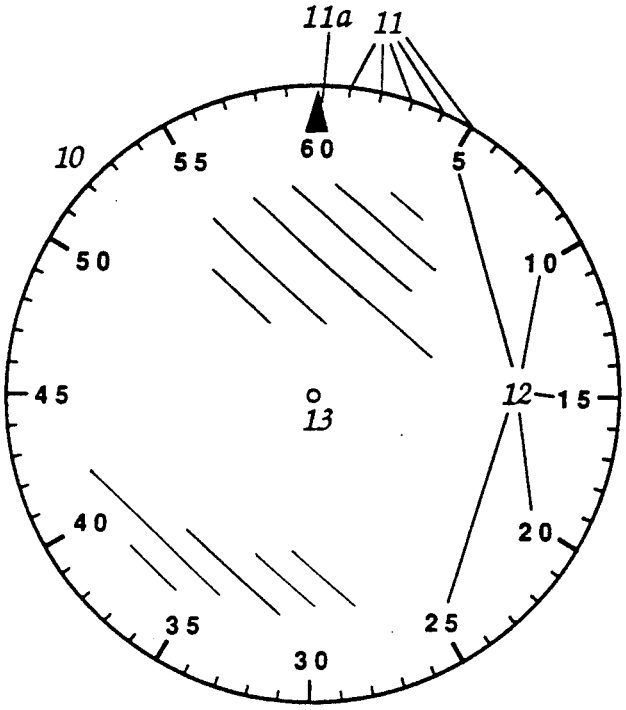
FIG. 1 is a front view of the face of the dial portion (10) of the invention.

In the preferred embodiment of the event recorder as a simulation timekeeper the rotatable dial (10) in FIG. 1 has at its edge 60 index marks (11) with associated numerals (12), appropriate for keeping track of seconds or minutes. The index mark (11*a*) located at the start or zero value of the index marks is more prominent, and is considered to be a pointer to the event condsidered current. The dial (10) is provided with a hole (16) with which it can be mounted on a surface (15) shown in FIG. 2. The surface (15) is of a substance such as glass, metal or plastic which allows writing and removal of that writing, as by a grease pencil or water soluble marker. It has a hole (17) in which the dial (10) can be mounted, and has a reference mark (16) which allows accurate advancement of the dial by units of time. In FIG. 3 the dial (10) is shown mounted on surface (15) using an axle (18), with sufficient friction to prevent the dial (10) from moving accidentally. The dial may be rotated by hand so that the pointer (11*a*) at the zero unit of the dial (10) moves from event to event on the erasable surface (15). At all times, the gradations (11) and numbers (12) at the edge of the dial (10) indicate how long, in the simulated units of time, it will take for the pointer to reach an event recorded at that number. Two complementary processes may thus be performed. If a person using the device knows that an event will happen a certain number of simulated units of time from the current time, he makes an indication of the event at the edge of dial (10) at that number on the writing surface (15). Likewise, if a person wishes to known how soon an event recorded on the device will happen, he need only look at the number currently aligned with the written indication of that event. When all known events have been recorded on the writing surface (15), the dial (10) is rotated clockwise by hand until the pointer (11*a*) is aligned with the first recorded event. When the pointer reaches the indication of the event, the scheduled event or activity happens, or is postulated to happen. At this point, the results of that event may cause further events to be known, all of which are recorded at the appropriate place on the dial. When again all known events are recorded, the dial is again advanced to the next recorded event. After the pointer is rotated past the indication of the event, the indication is removed from the clock.

When the dial makes one full revolution, the dial governing the next higher order of magnitude of time is advanced on gradation.

When a higher order dial reaches an event, the event is transferred down to the next lower dial, and a mark is made at the appropriate time on the lower order dial. The information concerning at what time on the lower order dial the event is to take place is normally contained in the description of the event written on the higher order dial. For example, along with the description of an event which is to take place in five years is the information that it will take place in a particular month, on a particular day, at a particular hour, minute, and second, if that information is necessary. When the designated year arrives, the event is moved to the designated month. When the designated month arrives, it is moved to the appropriate day, etc.

Figure 2:
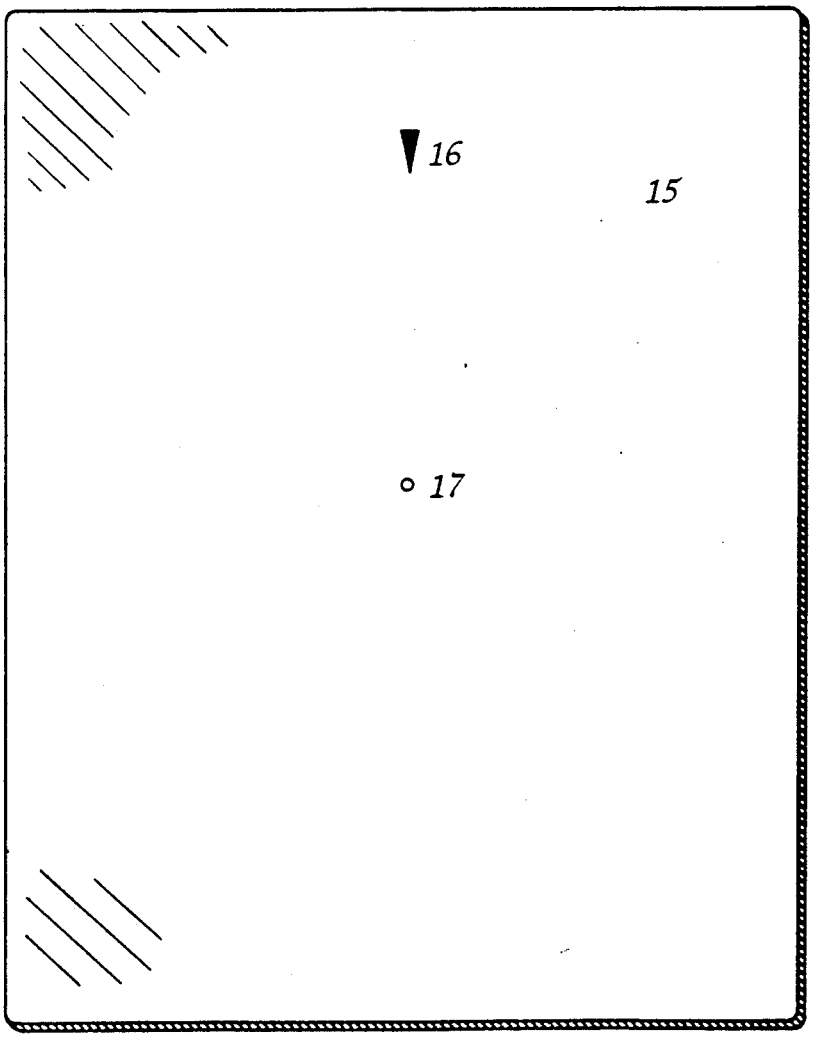
FIG. 2 is a front view of an embodiment of a rectangular surface (15) on which memoranda may be written or mounted.
Figure 3:
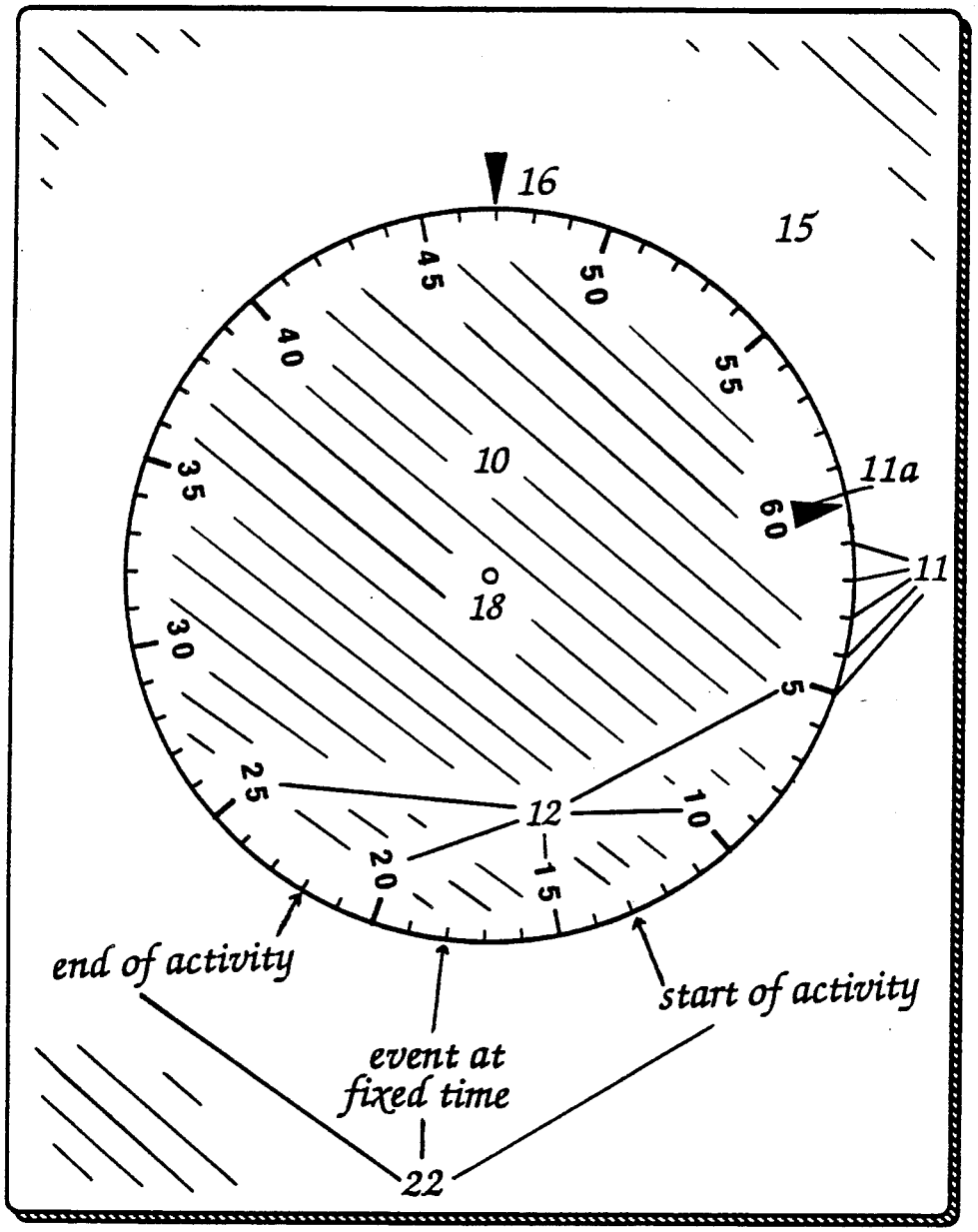
FIG. 3 is a front view of the disk (10) mounted on the surface (15), with the dial (10) rotated to indicate an event.
Figure 4:
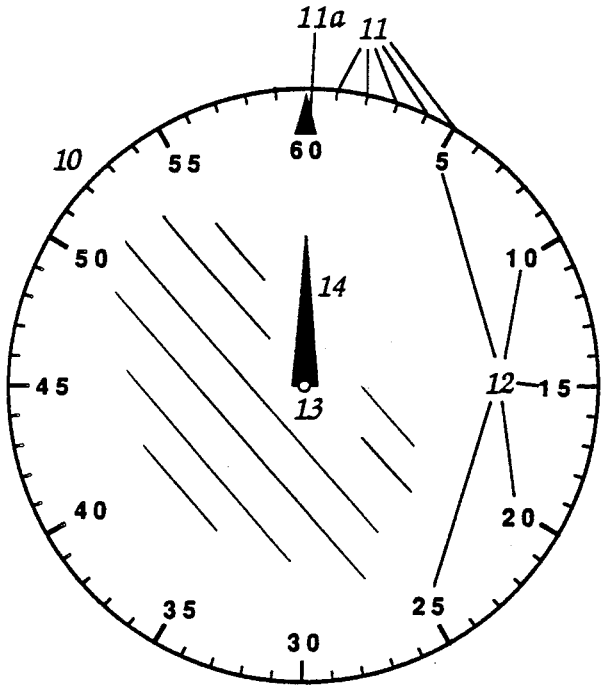
FIG. 4 is a front view of an embodiment of the dial (10) in which the dial is transparent, and with the addition of an interior hand (14).
Figure 5:
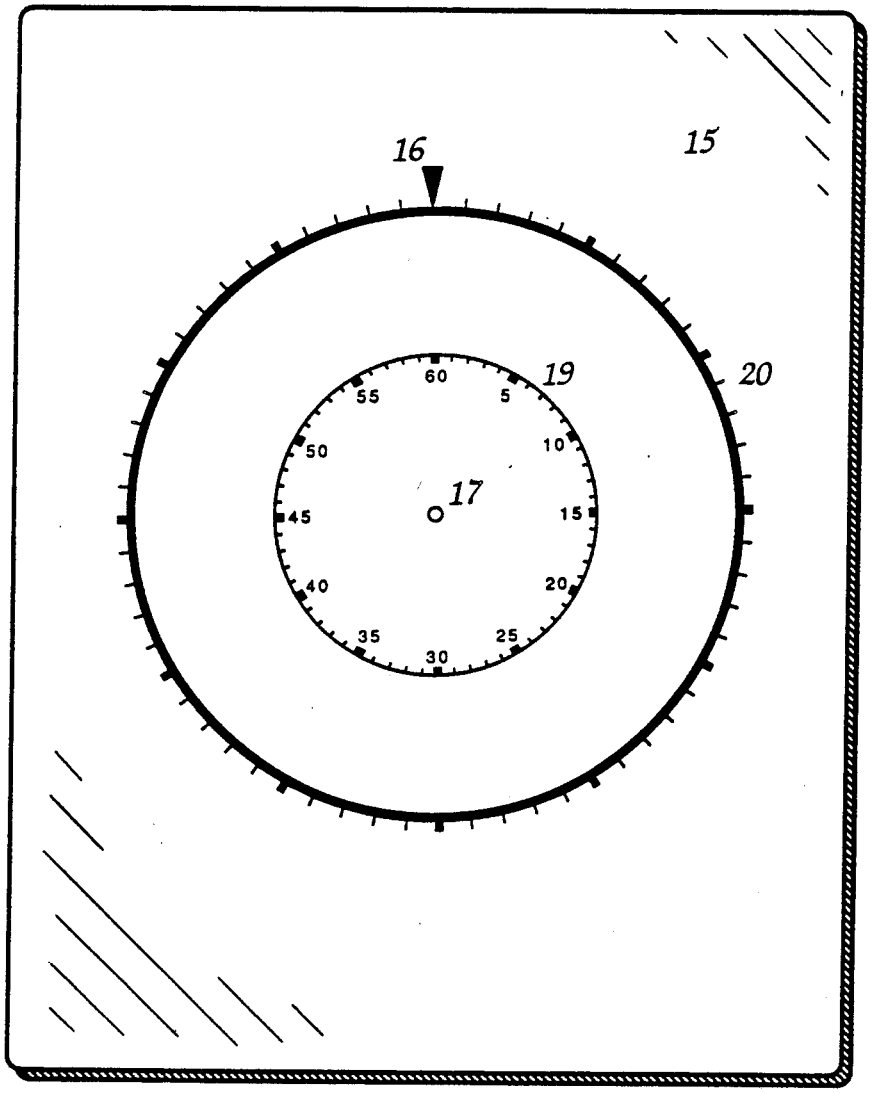
FIG. 5 is a front view of a second embodiment of a surface (15), on which to mount the transparent disk (10) of FIG. 4.
Figure 6:
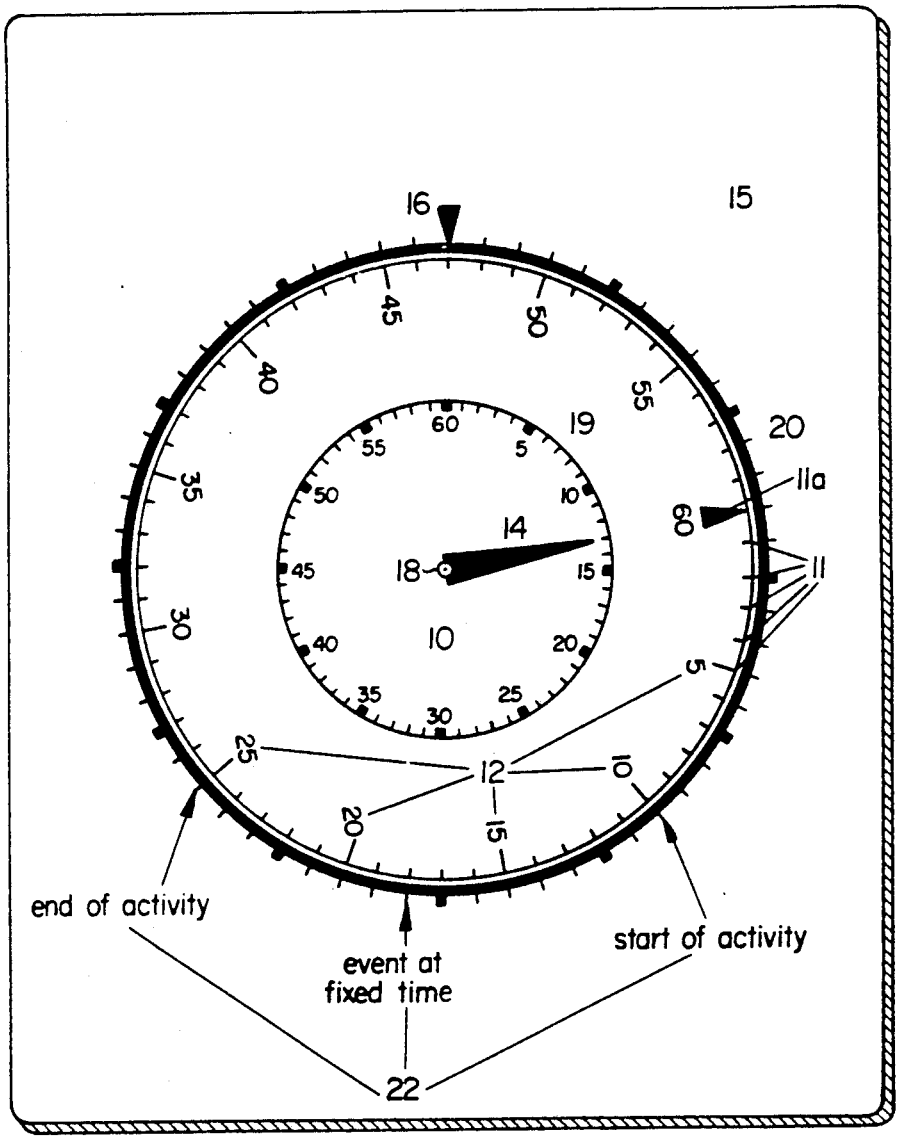
FIG. 6 is a front view of the disk (10) of FIG. 4, mounted on the surface (15) of FIG. 5.

In the simplest embodiment as in FIGS. 1 to 3, absolute time may not be required and the sequence of events on a scale of seconds or minutes may be all that is required. A more complex embodiment as shown in FIGS. 4 to 6. In FIG. 4, the dial is transparent, and has a clock hand (14) on its interior, extending radially toward the point on the circumference marked by the pointer (11*a*). FIG. 5 shows a corresponding surface bearing a second dial (19) which act as a clockface, and over which the interior hand (14) is moved to simulate the way that the hand of a clock moves over a clockface. This allows the determination of (simulated) absolute time, that is time of day, day of the month, etc. This addition allows the use not only of simulated time relative to the current time, but also on a simulated absolute scale.

In FIG. 5 at the edge of the dial is shown an additional set of gradations (20), which are fixed in place with respect to the memoranda (22), and which are used to prevent inaccuracy in placing or writing the memoranda (22).

B: Preferred Embodiment of Reminder Clock

Figure 7:
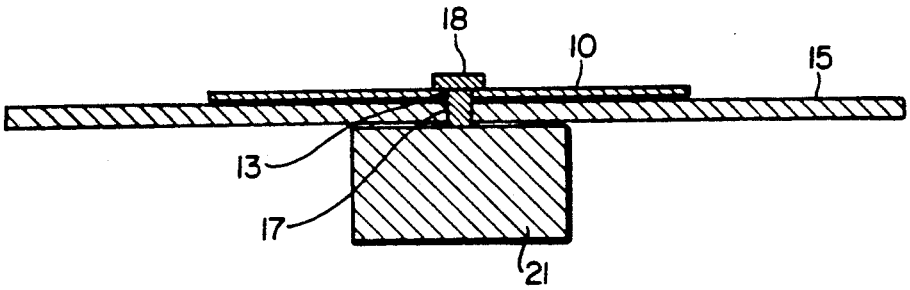
FIG. 7 is a side view of FIGS. 4 and 6, showing the disk (10) mounted on the surface (15), partly broken away to show a hub or spindle (18) as a means for such mounting, and including a clock mechanism (21) for rotating the disk (10).

When dealing with real processes such as manufacturing or cooking, real rather than simulated time is needed. The construction of a reminder clock is identical to that of the simulation timekeeper with the addition of one or more clock movements, which move the dials automatically. In FIG. 7 is shown a clock mechanism (21) of a suitable construction which rotates each dial at a rate appropriate for the scale of time dealt with by the device. In the example shown in the figures, with dials bearing 60 divisions suitable for seconds or minutes, the disk would rotate once per minute or hour, respectively. When multiple disks are used to allow the simultaneous use of different orders of magnitude of time, the clock mechanisms must be coordinated such that the full rotation of one corresponds to the advance of the disk dealing with the next higher order of magnitude by one gradation.

The preferred embodiment of a reminader clock for use in the home would have one sixty minute dial for use in cooking and other short term activities; one twenty four hour dial for use in scheduling the activities such as appointments, times for taking medicine, and errands of the day; one days dial with at least 31 days, for scheduling appointments and trips for the month, and possibly one months dial for scheduling long term plans such as vacations. All the dials might be mounted on the same large erasable surface, such as message boards such as are currently in use.

I claim:

1. A game device, for use in a game played by one or more players and wherein at least a first event and a second event occur at selected, different times in the furture in said game, said device comprising:

an indicator bearing a plurality of equally-spaced, sequential markings along a periphery thereof, the markings representing sequential time segments in which said selected events of said game will occur, and one of the markings being visibly distinct from the others in size, color, shape, or the like; and a fixed recording surface supporting said indicator for movement thereon and adapted to be erasably manually marked with the times of at least the first and second events, and said surface having permanent markings thereon adjacent the periphery of the indicator and corresponding to the markings on said indicator.

2. A game device as defined in claim 1, wherein the periphery of the indicator is circular and wherein the markings on the indicator and on the recording surface are also on circles concentric with the indicator.

3. A method of using a game device to record and track first, second, and other events occurring at selected, different times, the game device comprising: an indicator bearing a plurality of equally-spaced, sequential markings along a periphery thereof, the markings representing sequential times at which said selected events of said game may occur, one of the markings being visibly distinct from the others in size, color, shape, or the like, and a fixed recording surface supporting said indicator for relative movement thereon and adapted to be erasably manually marked with the times of said future events; the method comprising the steps:

marking said first and second future events upon the recording surface adjacent to the periphery of the indicator at selected times in accordance with their planned occurrence, moving the indicator such that the visually prominent mark on the indicator moves step-wise through each of said future events in the sequence of their planned occurrence, and as the game progresses, selectively marking additional future events upon the recording surface adjacent to the periphery of the indicator, using the indicator and markings thereon, in accordance with the times of their planned occurrence and relative to the position of the indicator.

* * * * *

UNITED STATES PATENT AND TRADEMARK OFFICE

CERTIFICATE OF CORRECTION

PATENT NO. : 5,098,101
DATED : March 24, 1992
INVENTOR(S) : Benjamin B. Jones

It is certified that error appears in the above-indentified patent and that said Letters Patent is hereby corrected as shown below:

On the title page, column 1, under "U.S. PATENT DOCUMENTS", delete "MacDonnell" and substitute therefor --MacDonell--.

On the title page, column 2, under "U.S. PATENT DOCUMENTS", delete Braajen" and substitute therefor --Braaten--.

In column 2, line 27, before "simulated" insert --be--.

In column 2, line 67, delete "secodns" and substitute therefor --seconds--.

In column 3, line 12, delete "sequency" and substitute therefor --sequence--.

In column 3, line 23, after "fashion" delete ",".

UNITED STATES PATENT AND TRADEMARK OFFICE

CERTIFICATE OF CORRECTION

PATENT NO. : 5,098,101
DATED : March 24, 1992
INVENTOR(S) : Benjamin B. Jones

It is certified that error appears in the above-indentified patent and that said Letters Patent is hereby corrected as shown below:

In column 4, line 38, delete "on" and substitute therefor --one--.

In column 4, line 56, before "shown" delete "as" and substitute therefor --is--.

Signed and Sealed this

Eleventh Day of October, 1994

Bruce Lehman

*Attest:*

BRUCE LEHMAN

*Attesting Officer*

*Commissioner of Patents and Trademarks*